US007371047B2

(12) United States Patent
Burmester et al.

(10) Patent No.: US 7,371,047 B2
(45) Date of Patent: May 13, 2008

(54) EXHAUST GAS TURBINE FOR AN EXHAUST GAS TURBOCHARGER

(75) Inventors: Hermann Burmester, Heidelberg (DE); Akihiro Ohkita, Frankfurt (DE)

(73) Assignee: iHi Charging Systems International GmbH, Heidelberg (DE)

( * ) Notice: Subject to any disclaimer, the term of this patent is extended or adjusted under 35 U.S.C. 154(b) by 122 days.

(21) Appl. No.: 11/295,139

(22) Filed: Dec. 6, 2005

(65) Prior Publication Data

US 2006/0133931 A1 Jun. 22, 2006

Related U.S. Application Data

(63) Continuation-in-part of application No. PCT/EP2004/004452, filed on Apr. 28, 2004.

(51) Int. Cl.
*F01D 25/26* (2006.01)

(52) U.S. Cl. ..... 415/204; 415/214.1

(58) Field of Classification Search ..... 415/213.1, 415/214.1, 215.1

See application file for complete search history.

(56) References Cited

U.S. PATENT DOCUMENTS 6,553,762 B2 * 4/2003 Loffler et al. ..... 415/203

FOREIGN PATENT DOCUMENTS

| | | |
|---|---|---|
| DE | 100 22 052 | 3/2001 |
| DE | 100 61 846 | 6/2001 |
| DE | 100 22 052 | 6/2002 |
| EP | 0 918 140 | 5/1999 |
| WO | WO 02/06637 | 7/2000 |
| WO | WO 02/29211 | 4/2002 |
| WO | WO 03/023192 | 3/2003 |

* cited by examiner

*Primary Examiner*—Richard A. Edgar
(74) *Attorney, Agent, or Firm*—Klaus J. Bach

(57) ABSTRACT

In an exhaust gas turbine for a turbocharger with a spiral housing consisting of sheet metal surrounding a guide vane structure and having a tangential inlet funnel and an outer shell which also consists of sheet metal and surrounds the spiral housing with an air gap, the spiral housing and the outer shell are pot-shaped and the ends adjacent the guide vane structure are delimited by parts of the guide vane structure, the spiral housing being connected to these parts by means of at least one axially flexible element.

13 Claims, 2 Drawing Sheets

EXHAUST GAS TURBINE FOR AN EXHAUST GAS TURBOCHARGER

This is a Continuation-In-Part Application of International Application PCT/EP2004/004452 filed Apr. 28, 2004 and claiming the priority of German application 103 25 649.0 filed Jun. 6, 2003.

BACKGROUND OF THE INVENTION

The invention relates to an exhaust gas turbine for a turbocharger having a spiral housing consisting of sheet metal.

An exhaust gas turbine for a turbocharger in which a spiral housing made from sheet metal is both fixedly connected to a contoured casing and clamped to a central bearing housing of the turbine via an intermediate ring by means of a clamping strip is known from WO 02/06637. According to one version of the exhaust gas turbine the intermediate ring can be designed integrally with the contoured casing or form a separate component. The spiral housing is composed of two sheet metal shells, of which one forms the spiral duct wall which faces the flow guide vane structure, while the other shell forms the outer spiral duct wall. The outer duct wall can be surrounded by another shell with an air gap for thermal insulation purposes. The spiral housing is of complicated design and is therefore complex in terms of manufacture and assembly. Furthermore, it is of considerable weight and in particular does not allow equalization of different thermal expansions of the individual housing parts relative to one another without considerable thermal stresses. Such thermal expansions can lead to malfunctions and result in premature wear. The adjusting mechanism for the guide vanes, a bearing ring for the guide vanes, the contoured casing and the guide vanes themselves can form a modular unit which can be preassembled.

A turbine housing for a turbocharger in which the spiral housing is of double-walled design is known from DE 100 22 052 A1. The inner wall which forms the spiral duct is attached by means of an inlet funnel, which opens tangentially into the spiral housing, to an inlet flange. The outer wall is welded to the inlet flange, while the inner wall has a sliding seat with respect to the outer wall and the inlet flange with a sliding seat, so that thermal expansions in the direction of the inlet funnel between the inner and outer wall do not generate thermal stresses. However, as a matter of principle, no equalization of the inner and outer wall of the spiral housing is provided in the axial direction of the exhaust gas turbine, so that, in the event of high temperature differences between the inner and outer shells in particular, durability can no longer be ensured on account of intense stresses.

It is the object of the present invention to provide an exhaust gas turbine having a two-shell turbine housing consisting of sheet metal parts which are simple and light and generate the smallest possible stresses under thermal influence.

SUMMARY OF THE INVENTION

In an exhaust gas turbine for a turbocharger with a spiral housing consisting of sheet metal surrounding a guide vane structure and having a tangential inlet funnel and an outer shell which also consists of sheet metal and surrounds the spiral housing with an air gap, the spiral housing and the outer shell are pot-shaped and the ends adjacent the guide vane structure are delimited by parts of the guide vane structure, the spiral housing being connected to these parts by means of at least one axially flexible element.

The outer shell can in this case be of largely cylindrical design, while the spiral housing forms a spiral duct corresponding to the requirements of desired flow rates, the flow cross section decreasing toward a guide vane structure. The spiral housing and the outer shell which are delimited at the end facing the guide vane structure by parts of the guide vane structure comprise a contoured casing, a ring and an intermediate ring. A clamping ring of V-shaped cross section clamps the outer shell via the intermediate ring to a central support housing of the turbocharger, while the inner spiral housing adjoins a part of the guide vane structure, for example the intermediate ring or the support ring, by means of at least one axially flexible element in such a way that the spiral housing can expand in the axial and radial directions under thermal influence without significant stresses being exerted on the adjoining parts of the guide vane structure or the outer shell.

The flexible element can be formed in a simple manner by a corrugated pipe-like part of the spiral housing which is integrally formed directly on the spiral housing during manufacture of the latter and expediently has a lower wall thickness than the rest of the spiral housing. According to a refinement of the invention, a further possibility is that the flexible element comprises a sliding seat which is provided between a part of the flow guide structure and the spiral housing. For this purpose, an intermediate ring or the support ring of the flow guide structure expediently has a shoulder, against which a preferably cylindrical attachment of the spiral housing rests and forms a sliding seat. The difference in diameter between a cylindrical attachment and the radial demarcation of the spiral duct is bridged by means of a radially oriented and integrally formed transition.

Furthermore, it is expedient to seal off the connection point in addition to the sliding seat by means of a heat-resistant sealing element, for example in the form of a seam which is integrally formed on the connection of the spiral housing and rests against the shoulder.

Particular advantages are obtained if an exhaust gas turbine includes a flow guide structure with a contour sleeve and a support ring which are connected to one another by means of spacer bolts for supporting adjustable guide vanes and forming a flow duct which is connected to a spiral duct formed by the spiral housing. The bearing ring is fastened to an intermediate ring, which is clamped to an adjoining housing part of the turbocharger by means of a clamping ring on an outward facing outer flange together with a flange of the outer shell. In this case, the bearing ring or the bearing ring and the intermediate ring form the end demarcation of the spiral duct, so that the number of elements required, the material outlay and the weight are very low. A very light turbine construction results in which the turbine housing has a low mass and low heat capacity, so that the optimum operating temperature is reached very quickly after start-up. Furthermore, it may be advantageous for the intermediate ring to be connected to the bearing ring by means of an elastically flexible support sheet metal ring. As a result, thermal expansions of the distributor do not subject the adjusting mechanism of the guide vanes and the bearing housing to thermal stresses.

The radially inner part of the spiral housing is expediently connected to the contoured casing by means of a base plate. The base plate, which can be integrally formed directly on the spiral housing or sealed off by means of a separate seal, simultaneously serves to seal off the spiral housing from the contoured casing. This can occur either in the axial direction or in the radial direction by means of a correspondingly acting clamping ring which presses the base plate against the contoured casing in the corresponding radial or axial direction. In this way, an additional seal can be provided between the base plate and the contoured housing.

The invention will become more readily apparent from the following description thereof on the basis of the drawings in which exemplary embodiments are illustrated. The drawing, the description and the claims comprise a large number of features in combination. The person skilled in the art will expediently also consider the features separately and combine them to form further meaningful combinations.

DESCRIPTION OF PARTICULAR EMBODIMENTS

Figure 2:
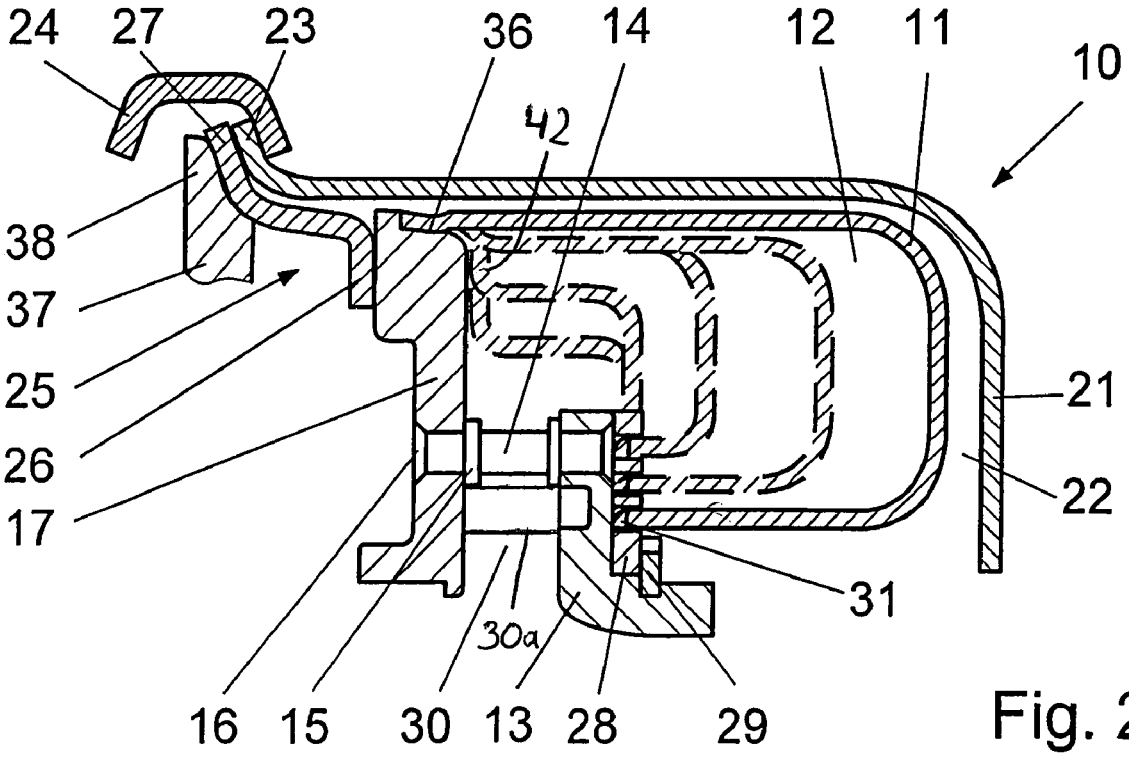
FIG. 2 shows a variant of FIG. 1.
Figure 3:
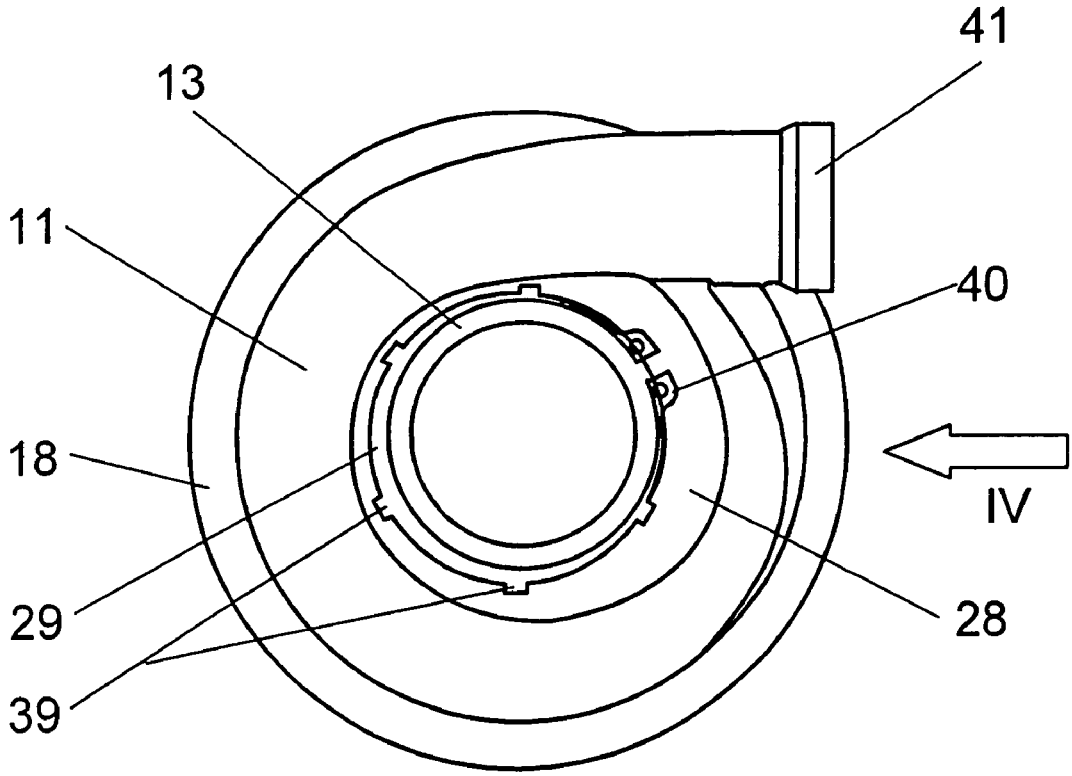
FIG. 3 shows an end view of an exhaust gas turbine according to FIG. 1 on a smaller scale without the outer shell and FIG. 4 shows a view in the direction of an arrow IV in FIG. 3.
Figure 4:
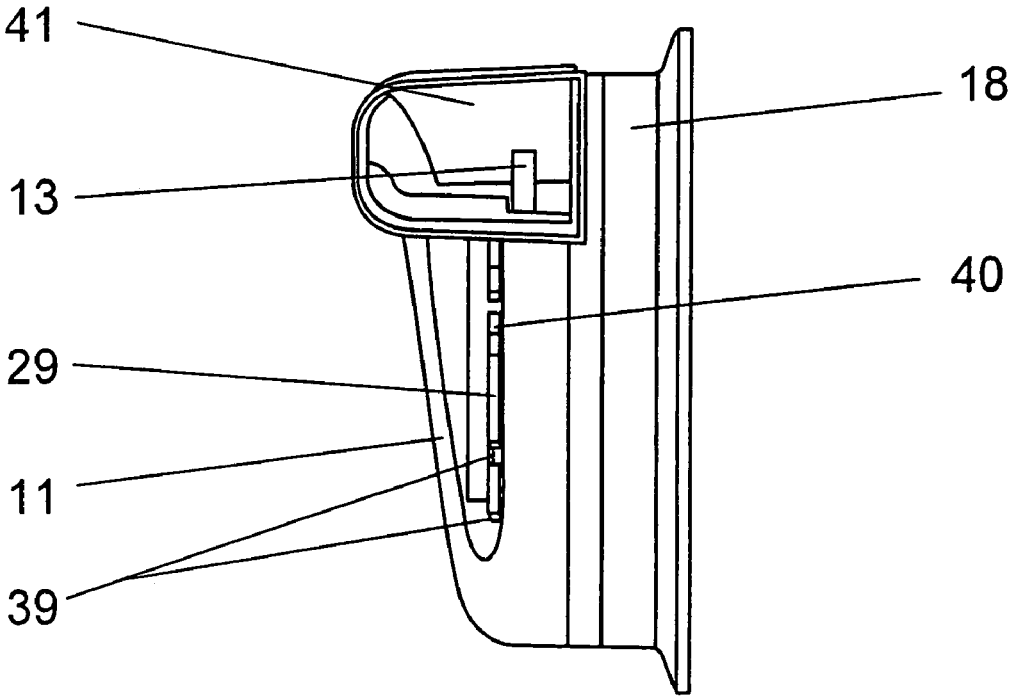

Only those parts of an exhaust gas turbine 10 which are pertinent to the invention are illustrated. The exhaust gas turbine 10 comprises a contoured casing 13 which is connected by means of spacer bolts 14 to a support ring 17 for adjustable guide vanes 30*a* which are illustrated in FIG. 2. The spacer bolts 14, of which a plurality are distributed about the circumference, have stops 15 on which the contoured casing 13 and the support ring 17 rest and are held by means of a rivet head 16 at the end of the spacer bolt 14. A flow duct 30 is formed between the contoured casing 13 and the support ring 17, which duct leads to a radially inner rotor which is not illustrated. The adjustable guide vanes 30*a* are arranged in the duct 30 distributed about its circumference.

Figure 1:
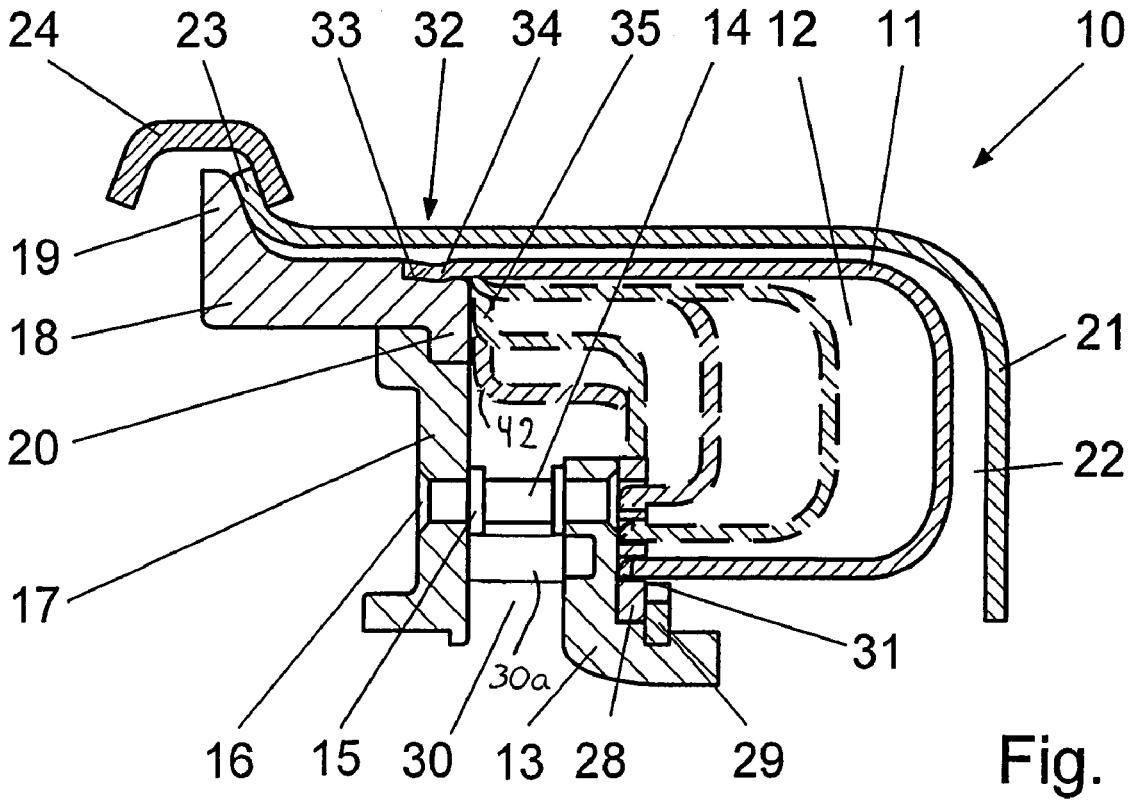
FIG. 1 shows half of a longitudinal section through an exhaust gas turbine without the rotor.

The support ring 17 is fastened to an intermediate ring 18, an outer conical flange 19 of which is clamped in a known manner by means of a clamping ring 24, which is v-shaped in cross section, against a central support housing of the exhaust gas turbine which is not illustrated. While the intermediate ring 18 in the embodiment of FIG. 1 has its inner radial flange 20 fastened directly to the support ring 17, the support ring 17 in the embodiment of FIG. 2 is connected by means of a support sheet metal ring 25 to a flange contour 38 of the support housing 37, which is only indicated, in that an inner flange 26 of the support sheet metal ring 25 is attached to the support ring 17 and an outer flange 27 of the support sheet metal ring 25 is clamped by means of the clamping ring 24 to a suitable flange contour 38 of the support housing 37. The support sheet metal ring 25 is elastically flexible and thus accommodates thermal expansions between the flow guide structure 13, 14, 17 and the housing of the turbocharger.

The flow duct 30 is surrounded radially on the outside by a spiral duct 12 through which exhaust gas is supplied. In order to accelerate the exhaust gas flow, the flow cross section of the spiral duct 12 narrows continuously from an inlet funnel 41, which extends tangentially with respect to the annular flow duct 30, so that the spiral housing 11 substantially forms the spiral duct 12. The narrowing of the cross section of the spiral duct 12 is indicated by a plurality of dashed sections of the spiral housing, which are disposed at an angle to one another and were rotated in the drawing plane in FIGS. 1 and 2.

An outer shell 21 surrounds the spiral housing 11 and, with the latter, forms an air gap 22 for thermal insulation purposes. The outer shell 21 does not need to have a spiral shape. For production reasons, it is expediently designed as a cylindrical pot, the conical flange 23 of which abuts the intermediate ring 18 and is clamped to the latter and if appropriate to the support sheet metal ring 25 (FIG. 2) by means of the clamping ring 24.

The spiral housing 11 likewise has the shape of a pot with a ring-shaped cross-section, the radially outer housing wall having a connection 34 at its free end facing the support ring 17, with which it rests against a shoulder 33 of the intermediate ring 18 (FIG. 1) or of the support ring 17 (FIG. 2) and forms a sliding seat 32. The sliding seat 32 is expediently sealed off by an additional seal, for example in the form of a seam 36 at the connection 34 of the spiral housing 11. Other heat-resistant sealing elements may also be provided.

The sliding seat 32 allows the spiral housing 11, which becomes very hot during operation, to freely expand both radially and axially without generating thermal stresses on the flow guide structure 13, 17 or the outer shell 21. The connection 34 can follow the outer contour of the spiral housing 11 in a spiral shape. The shoulder 33 may be correspondingly partially formed by means of a groove in the end side of the intermediate ring 18 and/or of the support ring 17. As illustrated, the shoulder is expediently in the form of a circular cylinder, so that a transition 35 bridges the distance between the connection 34 and the spiral-shaped cross-sectional contour of the spiral housing 11. Instead of, or in addition to, a sliding seat 3, the spiral housing 11 may be joined to the support ring via a flexible element or a bendable corrugation part 42 in order to prevent that the vane adjustment mechanism is detrimentally affected by the expansion of the spiral housing.

The radially inner spiral-shaped housing wall of the spiral housing 11 ends at a base plate 28, the outer contour of which is adapted to the radially inner spiral-shaped housing wall, and is expediently connected to the latter, for example by means of welding, with the result that sealing is also achieved between the spiral housing 11 and the base plate 28. The base plate 28 can however also be of cylindrical design in the outer region, but then has a spiral groove 31 for receiving the radially inner housing wall of the spiral housing 11. The base plate 28 may however also be, in the form of a flange, directly integrally formed in one piece with the spiral housing 11. In all embodiments of the base plate 28, the latter is connected sealingly to the contoured casing 13.

The sealing between the base plate 28 and the contoured casing 13 can be either axial or radial in that it is pressed against the contoured casing 13 by means of a clamping element 29 in the form of a clamping ring with spring tongues 39 and tool lugs 40. The illustrated sealing provides for an axial sealing. However, a radial sealing is conceivable in which a clamping ring, which surrounds the base plate 28, presses the base plate 28 against the contoured casing. To enhance the sealing action, heat-resistant sealing means may be disposed between the components 13, 28, 11.

What is claimed is:

1. An exhaust gas turbine (10) for a turbocharger comprising a spiral housing (11) consisting of sheet metal and surrounding a turbine inlet duct (30), with an adjustable guide vane structure (30*a*) disposed in the inlet duct (30) and also forming an inlet funnel (41) which extends tangentially, an outer shell (21) of sheet metal surrounding the spiral housing (11) in spaced relationship so as to form an air gap (22) therebetween, the spiral housing (11) and the outer shell (21) being pot-shaped and having open end sections adjacent the flow guide structure (13, 17) which are connected to the flow guide structure (13, 17), the end sections of the spiral housing (11) being connected to said flow guide structure (13, 17) by means of an axially resilient element comprising one of a corrugated part (42) of the spiral housing (11) and a sliding seat (32) between a part of the flow guide structure (13, 17,) and the spiral housing (11) so as to permit axial and radial expansion of the spiral housing (11) without exerting stresses on the. adjacent parts of the flow guide structure (13, 17) and without detrimentally affecting the adjustable guide vane structure (30*a*) disposed in the turbine inlet duct (30).

2. The exhaust gas turbine as claimed in claim 1, wherein the spiral housing (11) has, at its end face abutting the flow guide structure (13, 17, 18), a connection (34) which rests against a correspondingly designed shoulder (33) of a part of the flow guide structure (13, 17, 18) and forms the sliding seat (32).

3. The exhaust gas turbine as claimed in claim 2, wherein a sealing element (36.) is provided on the sliding seat (32).

4. The exhaust gas turbine as claimed in claim 3, wherein the sealing element (36) is a seam which is integrally formed on the connection (34) and rests against the shoulder (33).

5. The exhaust gas turbine as claimed in claim 2, wherein the flow guide structure comprises a contoured casing (13) and a support ring (17) which are connected to one another by means of spacer bolts (14) and form the flow duct (30) adjoining a spiral duct (12) formed by the spiral housing (11) with the adjustable guide vane structure (30) supported therebetween, the support ring (17) being fastened to an intermediate ring (18) which is clamped to an adjoining housing part of the turbocharger by means of a clamping ring (24) on an outward facing outer flange (19) together with a flange (23) of the outer shell (21).

6. The exhaust gas turbine as claimed in claim 5, wherein the shoulder (33) is formed on the intermediate ring (18) for forming a connection (34) between the intermediate ring (18) and the support ring (17).

7. The exhaust gas turbine as claimed in claim 5, wherein a support housing (37) is connected via a sheet metal ring (25) with flanges (26, 27) to the support ring (17) having a shoulder (33) for the connection (34) and forming a sliding seat (32).

8. The exhaust gas turbine as claimed in claim 1, wherein the radially inner part of the spiral housing (11) is connected to a contoured casing (13) of the flow guide structure (13, 17) by means of a base plate (28).

9. The exhaust gas turbine as claimed in claim 8, wherein the base plate (28) is integrally formed on the contoured casing (13).

10. The exhaust gas turbine as claimed in claim 8, wherein the base plate (28) forms a seal between the spiral housing (11) and the contoured casing (13).

11. The exhaust gas turbine as claimed in claim 10, wherein the base plate (28) is clamped to the contoured casing (13) by means of a clamping element (29).

12. The exhaust gas turbine as claimed in claim 11, wherein the clamping element (29) is a clamping ring which acts axially on the base plate (28) and rests in a groove of the contoured casing (13).

13. The exhaust gas turbine as claimed in claim 11, wherein the base plate (28) is sealed off in the radial direction from the contoured casing (13) by a concentric clamping ring which presses the base plate (28) against the contoured casing (13) in the radial direction.

* * * * *